United States Patent [19]

Healy

[11] 4,343,337

[45] Aug. 10, 1982

[54] FUEL DISPENSING NOZZLE

[76] Inventor: James W. Healy, 54 Plymouth Rd., Wakefield, Mass. 01880

[21] Appl. No.: 167,347

[22] Filed: Jul. 9, 1980

[51] Int. Cl.[3] ..... B65B 3/26; B65B 57/14

[52] U.S. Cl. ..... 141/226; 137/494; 137/625.18; 141/225; 141/302

[58] Field of Search ..... 137/458, 494, 625.18; 141/59, 198, 206–229, 301, 302, 305

[56] References Cited

U.S. PATENT DOCUMENTS 3,811,486 5/1974 Wood ..... 141/215 X 3,996,979 12/1976 Barr et al. ..... 141/302

*Primary Examiner*—Frederick R. Schmidt

*Attorney, Agent, or Firm*—W. R. Hulbert

[57] ABSTRACT

A fuel dispensing nozzle having an aspirator valve which closes an aspirator line when there is a high negative or positive pressure in the fuel tank being filled, the closing of the aspirator line decreasing pressure in a chamber so that a shaft is released whereby the nozzle automatically shuts off. The nozzle also has a poppet valve controlled with the fuel valve of the nozzle, which poppet valve seals a vapor return line through the nozzle when the fuel valve is shut off.

10 Claims, 3 Drawing Figures

FUEL DISPENSING NOZZLE

FIELD OF THE INVENTION

This invention relates to an improvement in the fuel dispensing nozzle covered by my U.S. Pat. No. 4,056,131 and my U.S. Pat. No. 4,057,086, particularly in regard to automatically shutting off the nozzle when there is a large positive or negative pressure in the fuel tank being filled.

BACKGROUND OF THE INVENTION

The background relating to fuel dispensing nozzles is fully set forth in my U.S. Pat. No. 4,056,131, and my U.S. Pat. No. 4,057,086, both hereby incorporated by reference.

To briefly summarize, in filling a vehicle's fuel tank, hydrocarbon vapors are displaced, and it is desirable to return these vapors to the underground fuel reservoir rather than discharge them into the atmosphere. For this purpose, both the fuel dispensing nozzles of the aforementioned patents have vapor return lines through which vapors from the tank are collected and carried back to the reservoir. If the vapor return line is blocked or if the vehicle tank is subjected to a high vacuum condition, the tank will be subjected respectively to a large positive pressure or a large negative pressure. It is extremely desirable that the nozzle shut off automatically under both these conditions. It is also desirable that the vapor return line be completely sealed when the nozzle is not pumping gasoline.

SUMMARY OF THE INVENTION

It is a principal object of this invention to provide a fuel dispensing nozzle which automatically shuts off when it detects a high positive or negative pressure in a vehicle fuel tank into which the nozzle is delivering fuel. It is also an object of this invention to provide a tight seal for the vapor return line when the nozzle is shut off.

In accordance with the invention there is provided, in a fuel dispensing nozzle for filling a fuel tank, the nozzle having a spout, a fuel conduit leading to the spout, a vapor return line associated with the spout for withdrawing displaced vapors from the fuel tank being filled and transporting them to a remote vapor collection system, a fuel valve for controlling the flow of fuel through the conduit, an aspirator line having its tip located with respect to said spout so as to be in communication with the interior of the tank being filled when the spout is inserted in the fill pipe, means for producing a negative pressure in the aspirator line and pressure sensitive means in communication with the aspirator line for closing the fuel valve when a predetermined negative pressure exists in the aspirator line, the following improvement. An aspirator valve is located in the aspirator line between its tip and the aforesaid pressure sensitive means, and pressure actuable means in communication with the aspirator line controls the aspirator valve, the pressure actuable means being arranged to respond and to close the aspirator valve when a predetermined negative or positive pressure is detected in the fuel tank being filled, thereby permitting the negative pressure in the aspirator line to reach the above-mentioned predetermined value so as to actuate the pressure sensitive means to close the fuel valve.

In preferred embodiments, the position of the aspirator valve is controlled by a diaphragm which causes the aspirator valve to close the aspirator line resulting in the closure of the vapor return line as described below if either a large positive or negative pressure is present in the tank. The closing of the aspirator valve causes a pressure loss in a chamber, which loss results in an upward movement of another diaphragm. This diaphragm movement is communicated to a plunger, the movement of which releases a lever allowing a fuel valve in the nozzle to close. In addition, a poppet valve is located in the vapor return line, arranged to operate in tandem with the fuel valve to tightly close the vapor return line when fuel flow through the nozzle ceases.

DESCRIPTION OF THE DRAWINGS

Other objects, features, and advantages of the invention will be apparent to those skilled in the art from the following description of a preferred embodiment taken together with the accompanying drawings, in which.

DESCRIPTION OF A PREFERRED EMBODIMENT

Figure 1:
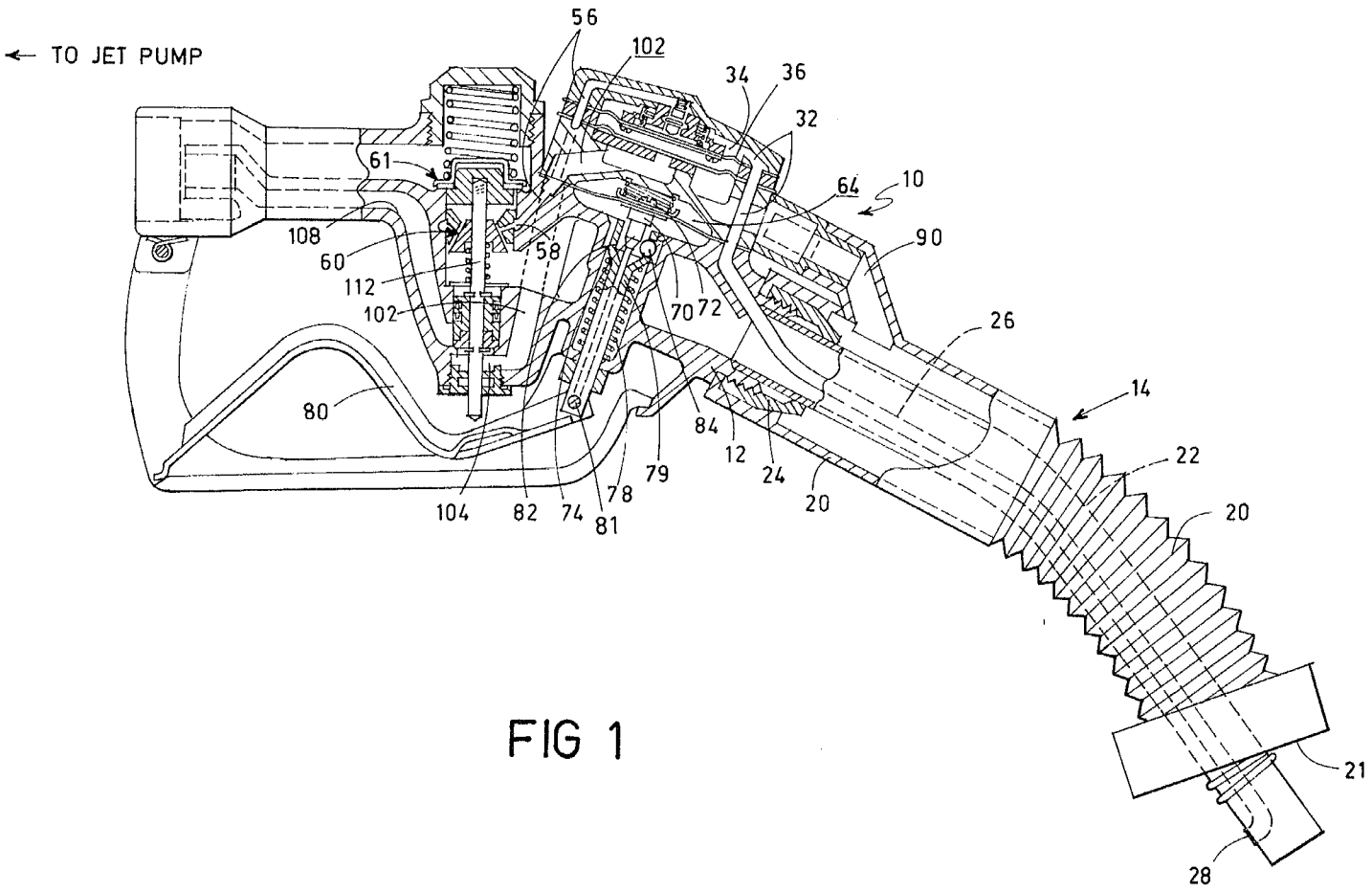
FIG. 1 is a longitudinal sectional view of a nozzle embodying the invention.

Referring first to FIG. 1, a fuel dispensing nozzle is generally shown by the numeral 10. The nozzle includes a housing or body portion 12 and a spout assembly 14.

Spout assembly 14 comprises an outer bellows unit 20 which surrounds the spout 22. Retainer assembly 24 secures the spout 22 to the body 12 and also seals one end of the bellows unit 20. The opposite end 21 of the bellows unit 20 is open so that the space inside the bellows unit 20 communicates with the inside of a vehicle fuel tank (not shown) when the nozzle is in place, the bellows end being arranged for sealing engagement with the fill pipe rim. An aspirator tube 26 is disposed inside the fuel spout 22, and the tube 26 terminates in an opening 28 in the side of fuel spout 22 near its outlet end so as to be in communication with the interior of the fuel tank when the latter is being filled. The other end of aspirator tube 26 communicates with passageway 32 in the nozzle body 12.

Figure 3:
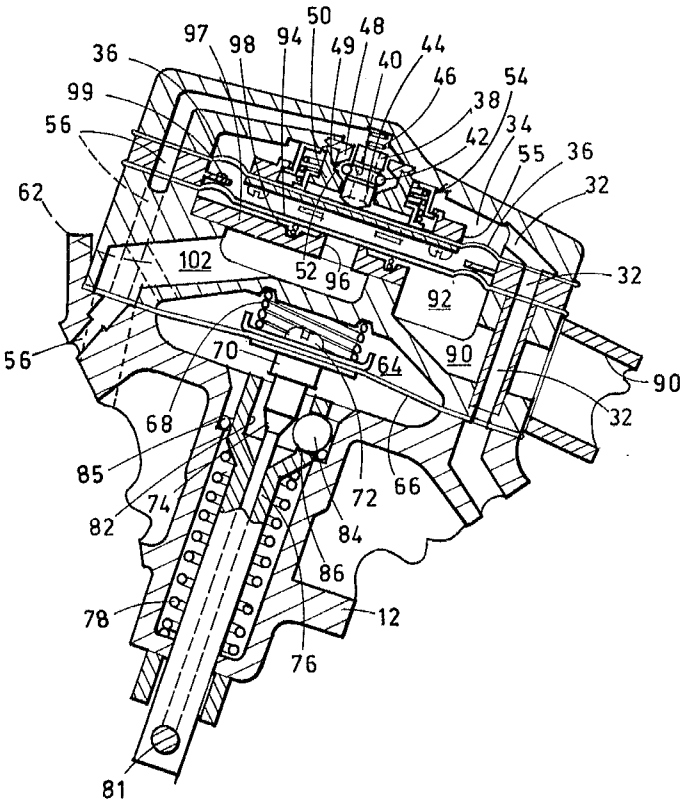
FIG. 3 is a similar view of another portion of FIG. 1.

As best seen in FIG. 3, passageway 32 is in communication with valve chamber 34. The lower portion of chamber 34 is bounded by a diaphragm 36. The bottom of the movable plug 38 of the aspirator valve rests on the diaphragm 36. Valve member 38 is generally cylindrical having a centrally disposed annular groove 40 containing an O-ring 42. Three longitudinal grooves 44 (only one shown) extend the length of the outside of valve member 38 which is spring-biased downward by spring 46. A valve retainer 48 is disposed in the housing 12 at the top of chamber 34. Valve retainer 48, which has an angled bottom 49, surrounds the top portion of plug 38. Valve seat 50, which is also connected to the housing 12, surrounds the lower portion of the plug 38. Valve seat 50 has an angled top surface 52. O-ring 42 is disposed between the angled top 52 of the valve seat 50 and the angled bottom 49 of the valve retainer 48.

Spring cage assembly 54 is disposed between the top of the chamber 34 and the diaphragm 36. Assembly 54 is held in place by retaining ring 55, which ring 55 is attached to the diaphragm 36. Spring cage assembly 54 serves to spring bias the diaphragm 36 downwardly away from the top of the chamber 34.

An aspirator channel 56 extends from the top of the chamber 34 above the aspirator valve to a small outlet 58 (FIG. 2) adjacent to the aspirator assembly 60 and fuel valve 61. Fuel valve 61, its operation and its arrangement with outlet 58 and aspirator assembly 60 are virtually the same as in my U.S. Pat. Nos. 4,056,131 and 4,057,086.

The aspirator channel 56 is also connected by passageway 62 to another chamber 64 (FIG. 3). The bottom of chamber 64 is bounded by second diaphragm 66. Spring 68 biases diaphragm 66 downwardly away from the top of the chamber 64, and a steel rod 70, attached to diaphragm 66 by machine screw 72 extends downwardly from chamber 64 through a suitable bore in body 12. Portion 74 of rod 70 is tapered, as shown. Hollow shaft 76, surrounding rod 70, is spring biased upwardly by spring 78. The lower end of shaft 76 is connected to lever arm 80 by pin 81 (FIG. 1). The upper end of shaft 76 has a hollow, enlarged head 82 which surrounds rod 70 and houses three circumferentially spaced balls 84, only one of which is shown, which lock against latching ring 85. There are ball-receiving slotted openings 86 in the side of enlarged head 82.

Figure 2:
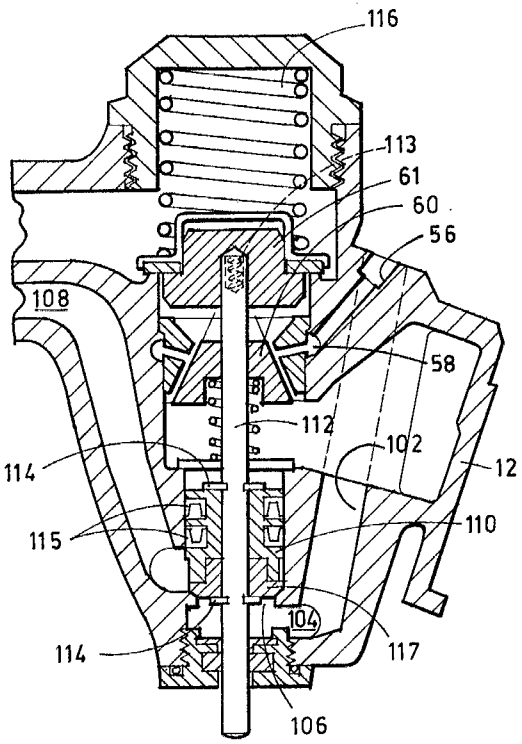
FIG. 2 is a similar view on a somewhat large scale of a portion of FIG. 1.

The space between the bellows unit 20 and the fuel spout 22 is connected by vapor return conduit 90 to still another chamber 92 (FIGS. 1 and 3). The top of chamber 92 is bounded by a third diaphragm 94, which is spring biased by spring 98 away from port 96 in orifice plate 97. Diaphragm 94 is below diaphragm 36 of the valve chamber 34, and the area therebetween is vented to the atmosphere through opening 99. This arrangement is similar to that shown in my U.S. Pat. No. 4,056,131. Port 96 communicates with vapor return channel 102, which in turn communicates with chamber 104, as best seen in FIG. 2. Chamber 104 communicates through valve opening 106 with vapor return line 108. Vapor return line 108 is intended to connect to vapor inlet of the jet pump of my pending U.S. patent application Ser. No. 144,249, filed Apr. 28, 1980, to return the vapors to the reservoir from which the fuel is being drawn.

Poppet vapor valve 110 is arranged to open and close vapor line 108 and is held on stem 112 by retaining rings 114. The valve 110 has a pair of U-cup seals 115 surrounding its upper portion and a valve seal 117 at its lower end. Spring 116 normally biases the movable plug of poppet valve 110 downwardly so that valve seal 117 closes valve opening 106 between passages 102 and 108.

To insure that manufacturing tolerances will not impair valve function and result in having a fuel valve seat leaving the vapor valve partially open, I have provided compression spring 113 which insures that fuel valve 61 will close first, followed by positive closure of vapor valve 110 when rod 112 shifts downwardly. The two valves operate in tandem shifted by powerful coil spring 116. When valve 61 is closed, spring 113 continues to act on rod 112 thereby completing the closure of the vapor valve.

OPERATION

When the nozzle 10 is in use, the fuel spout 22 is placed inside the fill pipe of a vehicle's fuel tank (not shown) with the bellows sealing against the fill pipe's rim. The aspirator tube 26 of the spout assembly 14 communicates with the interior of the tank through opening 28. Similarly, the space between the bellows unit 20 and the fuel spout 22 is in communication with the tank's interior because the fuel spout 22 is of considerably less diameter than that of the tank's fill opening.

If the aspirator opening 28 is not immersed in liquid, the nozzle can be turned on by pulling up lever 80 against the force of spring 116. This moves the valve stem 112 upwardly and opens fuel valve 61 and vapor valve 110. Fuel then flows through the nozzle and out fuel spout 22 into the fill pipe. This is all as explained in my U.S. Pat. No. 4,057,086. The liquid flowing past the small outlet 58 adjacent the aspirator assembly 60 causes a venturi effect which pulls a vacuum in channel 56, grooves 44 of the aspirator valve 38, valve chamber 34, passageway 32 and aspirator tube 26.

Referring to FIG. 3, the venturi effect also lowers the pressure in chamber 64, which is in communication with passage 56 through passage 62, threby tending to lift diaphragm 66 which is, however, restrained from upward movement by the locking action of the three balls 84 which are held in their radially outward positions by bearing against the enlarged portion 74 of the rod 70. A venturi produced vacuum level of 25 to 30 inches of water will in turn produce sufficient force on the diaphragm 66 to lift the rod 70, overcoming the force exerted by spring 68. Such an increase in vacuum would occur, for example, if the tip 28 of tube 26 were immersed in liquid fuel, indicating the vehicle's tank is full. When this occurs the three balls are then free to move radially inwardly and thus no longer engage the latching ring 85, thereby releasing hollow rod 76 to move downwardly. The moment that shaft 76 is released it is pulled downwardly by the forward end of the lever 80 (FIG. 1) to which it is pivoted by pin 81, thereby compressing spring 78. This is true because the lever 80 is forced downwardly by spring 116 acting through stem 112. The characteristics of spring 116 are selected to exert sufficient force to overcome the less powerful spring 78. When this occurs both the main fuel valve 61 and the poppet valve 110 (FIG. 2) are instantly closed. The parts are disposed and arranged to permit sufficient downward movement of rod 76, and, therefore, one end of lever 80, to insure that the fuel valve 61 is fully closed even when the lever 80 is held in what would be its fully open position. Further details of the function just described may be found in U.S. Pat. Nos. 2,582,195 and 2,528,747.

If there is a large positive pressure, i.e., greater than 10" $H_2O$, in the fuel tank, such as would be caused by vapor buildup in the tank if the vapor return line became blocked, the pressure in aspirator valve chamber 34 will increase. This increase in pressure will move the diaphragm 36 downwardly. This is because the area below the diaphragm 36 is vented to atmosphere by opening 99, and, therefore, the relative pressure in chamber 34 controls the position of the diaphragm 36. As diaphragm 36 moves downwardly, aspirator valve 38 closes because O-ring 42 will seat against the angled top 52 of valve seat 50 thereby blocking the passageway through the grooves 44 of the valve 38. When this happens, the aspirator line is sealed. The fuel flow is continuing, however, and this results in a severe pressure drop in chamber 64. Diaphragm 66 moves upwardly, and the narrow portion of rod 70 becomes positioned adjacent balls 84. The balls then fall sufficiently inside the enlarged head of shaft 76 to free the latter to move downwardly. The lever arm 80 is no longer held in place by the locked shaft, and spring 116 will force stem 112, shaft 74 and lever 80 downwardly. This downward movement of stem 112 closes both fuel valve 61, shutting off the flow of fuel through the nozzle, and vapor valve 110.

The same result occurs when there is too much of a vacuum, i.e., $-10''$ $H_2O$, in the fuel tank. Then, the large negative pressure is communicated to aspirator valve chamber 34. This causes diaphragm 36 to move upwardly, and the O-ring 42 of valve 38 will seat against the angled bottom 49 of the valve retainer 48. This blockage in the aspirator line has the same effect on the diaphragm 66 of the chamber 64 as before. Again, the shaft 74 is released, and this allows spring 116 to close the fuel valve 61 and vapor valve 110.

The operation of the vapor return line from the area between the bellows unit 20 and the fuel spout 22 is the same as for the return line in my U.S. Pat. No. 4,056,131. However, poppet valve 110 has been added to completely seal this line when the nozzle is turned off. As can be seen, movement of the valve 110 is controlled by the stem 112 which also controls the fuel valve 61 so that the poppet valve 110 closes when the fuel valve 61 does. In addition, the area of the U-cup seals 115 is greater than the area of the valve seal 117 so that the valve seats more tightly under vacuum conditions. The spring 113 insures full closure of valve 110 whenever the main fuel valve is closed, thereby eliminating the need for very fine manufacturing tolerances for this assembly. When the main valve body starts downwardly the body of the vapor valve travels with it. When the body of the main fuel valve is seated the spring 113 continues to push the body of the vapor valve to seated and closed position. The two valves thus operate in tandem.

Of course, when the conditions which caused the shutdown are eliminated the parts will return to their normal working positions. This occurs when the handle 80 is released thereby causing it to be disengaged from the bottom of pin 112 so that the spring 116 will retain the valves 61 and 110 closed, full seating of the latter being insured by the action of spring 113. There is now no downward force being exerted on hollow shaft 76 and it is drawn upwardly to the position shown in FIG. 3 by the action of spring 78 pressing against its enlarged upper portion. The balls 84 are now free to move radially outwardly into the slots provided for them. Since the negative pressure which caused diaphragm 66 to move upwardly is gone, spring 68 will push rod 70 down to its former position, the tapered surfaces of its upper part wedging the balls radially outwardly and locking the parts together in their original condition.

What is claimed is:

1. In a fuel dispensing nozzle for filling a fuel tank, said nozzle having a spout, a fuel conduit leading to the spout, a vapor return line associated with the spout for withdrawing displaced vapors from the fuel tank being filled and transporting them to a remote vapor collection system, a fuel valve for controlling the flow of fuel through the conduit, an aspirator line having its tip located with respect to said spout so as to be in communication with the interior of the tank being filled when said spout is inserted in the fill pipe, means for producing a negative pressure in said aspirator line and pressure sensitive means in communication with said aspirator line for closing said fuel valve when a predetermined negative pressure exists in said aspirator line, the improvement which comprises an aspirator valve in said aspirator line located between said tip and said means for producing a negative pressure, and pressure actuable means in communication with said aspirator line for controlling said aspirator valve, said pressure sensitive means being in communication with said aspirator line between said aspirator valve and said means for producing a negative pressure, said pressure actuable means being arranged to respond to both negative and positive pressures in said line and to close said aspirator valve when either of a predetermined negative or positive pressure is detected in the fuel tank being filled, thereby permitting the negative pressure in said aspirator line to reach said predetermined value at said pressure sensitive means so as to actuate said pressure sensitive means to close said fuel valve.

2. The combination of claim 1 wherein said pressure actuable means comprises a chamber bounded by a first diaphragm, said chamber being in communication with the interior of said tank through a portion of said aspirator line.

3. The combination of claim 2 wherein said aspirator valve is so disposed and arranged in said chamber that either upward or downward movement of said first diaphragm will cause said aspirator valve to close.

4. The combination of claim 3 wherein said aspirator valve is spring biased into contact with said first diaphragm.

5. The combination of claim 1 wherein said aspirator valve further comprises a generally cylindrical movable plug having at least one vertical channel in its side and an annular O-ring around its midsection.

6. The combination of claim 5 wherein the movable plug of said aspirator valve is disposed in an inner chamber of a retaining means so that a fluid flow path exists through said valve channel when said O-ring is not in contact with the top or bottom of said inner chamber.

7. The combination of claim 6 wherein the top and bottom of said inner chamber are angled whereby said O-ring may seat against either of them.

8. The combination of claim 1 wherein said vapor return line is provided with a poppet valve, said poppet valve being connected to said fuel valve so that said valves open and close in tandem.

9. The combination of claim 8 wherein said poppet valve has a sealing face of smaller area than sealing means attached to said valve downstream from said sealing face.

10. The combination of claim 9 further including resilient means acting between said fuel valve and said poppet valve to insure full closure of the latter when the former is seated.

* * * * *